US006061843A

United States Patent [19]

Rump et al.

[11] Patent Number: 6,061,843

[45] Date of Patent: May 16, 2000

[54] METHOD FOR AUTOMATICALLY TRIGGERING A FLUSHING EVENT

[75] Inventors: Hans Rump, Unna-Massen; Norbert Pieper, Selm; Jörg Hiller, Wetter; Jan Schwarze, Krefeld-Forstwald, all of Germany

[73] Assignee: Keramag Keramische Werke AG, Germany

[21] Appl. No.: 08/564,044

[22] PCT Filed: Mar. 18, 1995

[86] PCT No.: PCT/EP95/01016

§ 371 Date: Nov. 30, 1995

§ 102(e) Date: Nov. 30, 1995

[87] PCT Pub. No.: WO95/27104

PCT Pub. Date: Oct. 12, 1995

[51] Int. Cl.[7] ..... E03D 13/00

[52] U.S. Cl. ..... 4/302; 4/DIG. 3

[58] Field of Search ..... 4/302, 303, 304, 4/DIG. 3

[56] References Cited

U.S. PATENT DOCUMENTS

| | | | |
|---|---|---|---|
| 2,707,482 | 5/1955 | Carter | 4/DIG. 3 |
| 3,751,736 | 8/1973 | Egli | 4/DIG. 3 |
| 4,309,781 | 1/1982 | Lissau | 4/304 |

FOREIGN PATENT DOCUMENTS

| | | |
|---|---|---|
| 2114493 | 6/1972 | France . |
| 2200413 | 4/1974 | France . |
| 9012652 | 12/1990 | Germany . |
| 9200161 | 6/1992 | Germany . |

*Primary Examiner*—Robert M. Fetsuga

*Attorney, Agent, or Firm*—Robert W. Becker & Associates

[57] ABSTRACT

In a method for automatically triggering flushing of a urinal with water an electrically actuatable shut-off valve is arranged in the water inlet line for shutting off water flow. A temperature sensor is positioned at a siphon of the urinal. Signals generated by the temperature sensor are sent to an electronic control and computing device. A temperature gradient is determined with the electronic control and computing device based on the signals generated by the temperature sensor. The shut-off valve is opened for flushing the urinal when the temperature gradient exceeds a preset limit.

2 Claims, 2 Drawing Sheets

METHOD FOR AUTOMATICALLY TRIGGERING A FLUSHING EVENT

BACKGROUND OF THE INVENTION

The invention relates to a method for automatically triggering a flushing event for urinals with an electrically actuatable shut-off valve positioned in the water inlet line and with a temperature sensor arranged at the siphon, wherein the signals of the temperature sensor are evaluated in an electronic control and computing device for controlling the shut-off valve.

From German Gebrauschmuster application 92 00 161 a urinal with an automatic temperature-controlled flushing device is known in which a temperature sensor arranged exterior to the siphon triggers a flushing event as soon as a temperature increase, due to the presence of urine, is detected. This is supposed to avoid disadvantages which result from temperature increases within the siphon resulting in signals that cannot be evaluated when arranging temperature sensors within the siphon. However, even the arrangement of temperature sensors exterior to the siphon does not in all cases result in the generation of signals that can be easily evaluated.

It is an object of the invention to improve the aforementioned method for automatically triggering a flushing event for urinals such that with at least one temperature sensor arranged within the siphon under any operating conditions signals are generated that are reliably evaluatable for triggering a flushing event.

SUMMARY OF THE INVENTION

The solution to this object according to the invention is characterized in that with the control and computing device based on the values produced by the temperature sensor the temperature gradient is determined and upon exceeding a preset minimal value for the temperature gradient a flushing event is triggered.

Accordingly, the inventive method for automatically triggering flushing of a urinal with water is primarily characterized by the following steps:

- arranging an electrically actuatable shut-off valve in the water inlet line for shutting off water flow;
- positioning a temperature sensor at a siphon of the urinal;
- sending signals generated by the temperature sensor to an electronic control and computing device;
- determining with the electronic control and computing device a temperature gradient based on the signals generated by the temperature sensor; and
- opening the shut-off valve for flushing the urinal when the temperature gradient exceeds a preset limit.

Preferably, the method further comprises the step of delaying the step of opening the shut-off valve.

With the inventive method a flushing event is triggered, independent of the respective absolute temperature within the siphon and even for slow temperature changes due to heating or cooling of the ambient air, when the speed of the temperature change, i.e., the change of the detected temperature over time, exceeds a certain preset value, for example, due to introduction of urine or waste water into the urinal. Since with the inventive method it is not the absolute temperature, but the temperature increase over time that is detected with the aid of the control and computing device, the invention prevents extraneous flushing events which could be caused by an increase or decrease of the absolute temperature resulting from heating or cooling of the ambient air and detected by the temperature sensor. On the other hand, a relatively small change of the temperature gradient, for example, a temperature change of 0.2° C. per second, is sufficient to trigger the desired flushing event because such a change of the temperature gradient cannot be caused by heating or cooling with ambient air, but exclusively by introducing urine or waste water.

Since in the inventive method the temperature sensor is arranged within the siphon of the urinal, i.e., is invisible, the installation of visible parts such as light barrier or infrared sensors for triggering the flushing event are obsolete. This reduces the risk of vandalism that is especially caused by recognizing visible control parts.

According to a further feature of the invention it is finally suggested to perform the triggering of the flushing event with delay. This ensures that the flushing event takes place only after completion of use of the urinal.

BRIEF DESCRIPTION OF THE DRAWINGS

The drawing schematically shows one embodiment of a device for automatically triggering a flushing event for flushing a urinal. It is shown in.

DESCRIPTION OF PREFERRED EMBODIMENTS

Figure 1:
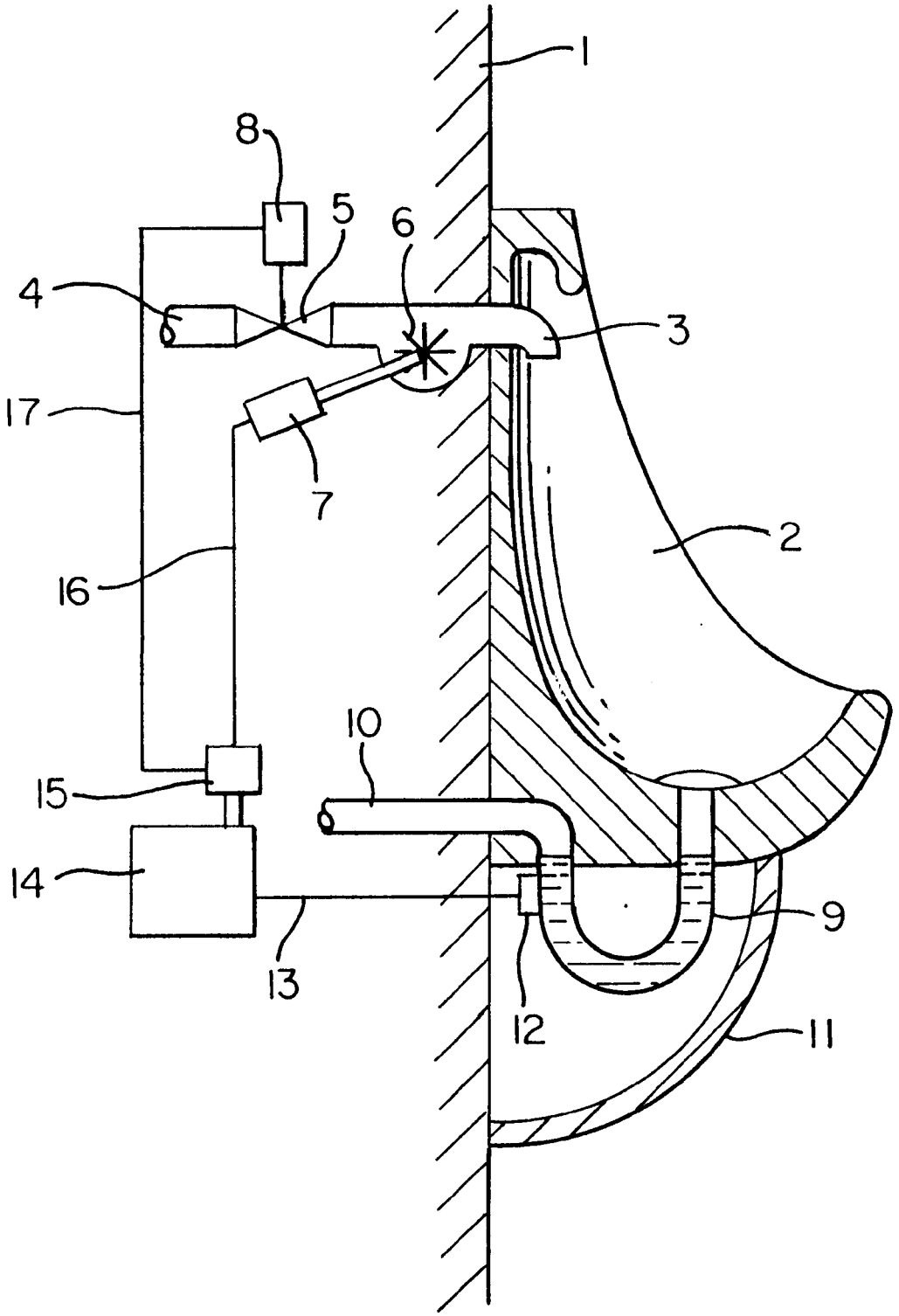
FIG. 1 a schematic vertical section of a urinal with a temperature sensor arranged at the siphon.

In the schematic vertical section of FIG. 1 a urinal 2 fastened to a wall 1 is shown having a water outlet 3 connected to a water inlet line 4.

In this water inlet line 4 a water turbine 6 is arranged downstream of the shut-off valve 5 which water turbine drives an electric generator 7. The actuation of the shut-off valve 5 is effected by a solenoid 8.

At the lowest point of the basin of the urinal 2 a siphon 9 is connected which opens into an outlet line 10. A temperature sensor 12 is arranged at the siphon 9 which is protected against unauthorized access by a cover 11. The temperature sensor 12 is connected with a signal line 13 with the electronic control and computing device 14. The energy supply of this electronic control and computing device 14 is effected by a capacitor 15 whose charge voltage is generated by the electrical energy produced with the generator 7 and supplied to the capacitor 15 via a charge line 16. Via a control line 17 the electronic control and computing device 14 is connected to the solenoid 8.

Figure 2:
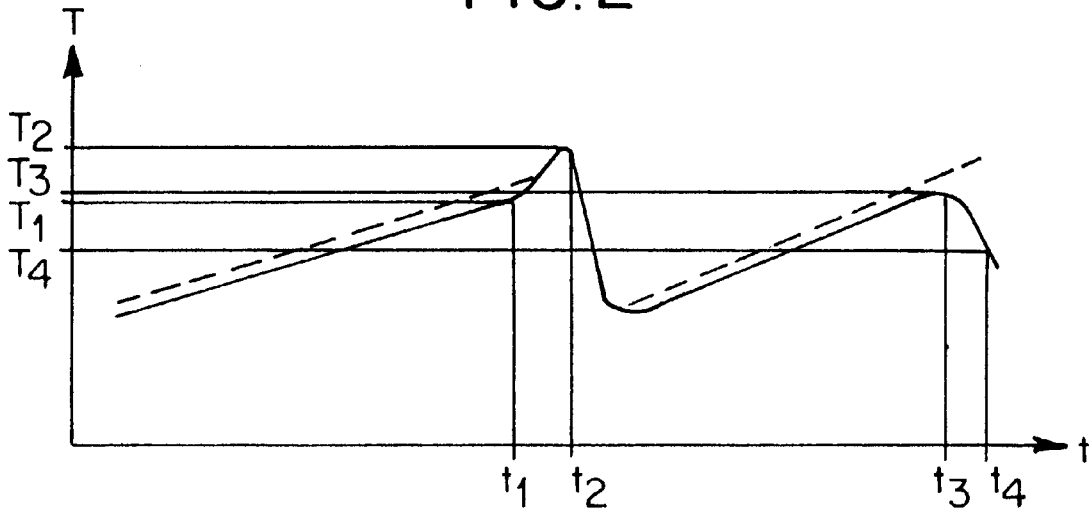
FIG. 2 a diagram of the temperature course over time.

In order to trigger a preferably time-delayed flushing event upon using the urinal 2, the control and computing device 14 determines, based on the values provided by the temperature sensor 12, the temperature gradient within the siphon 9. The diagram according to FIG. 2 shows in solid lines the temperature course over time t. It is shown that after a previous flushing event the water temperature of, for example, 12° C. slowly increases to room temperature $T_1$ of, for example, 20° C. due to the warm ambient air. When at the time $t_1$ urine of a temperature of approximately 36° C. is introduced into the urinal 2 and reaches the siphon 9, the temperature T rises substantially faster from the value $T_1$ to the value $T_2$ than by being warmed by ambient air. The temperature gradient which is determined by the control and computing device 14, i.e., the change of the detected temperature T over time t, exceeds a preset minimal value for the temperature gradient, which is shown in the diagram as a dotted line parallel to the curve of temperature T. At the time $t_2$ the control and computing device 14 thus triggers a flushing event.

Due to this flushing event cold water is again introduced into the siphon 9 so that the temperature detected by the temperature sensor 12 within the siphon 9 drops as shown in the diagram of FIG. 2. Subsequently a slow increase of the temperature takes place due to the warmer ambient air.

When due to the introduction of cold waste water at the time $t_3$ the temperature T rapidly drops from the value $T_3$ to the temperature $T_4$, a negative change of the temperature gradient results in this scenario and the preset minimal value is exceeded. Accordingly, at the time $t_4$ a flushing event is triggered. Since this is performed with water that is even colder, the temperature falls within the siphon 9 even after completion of the flushing event, as is shown at the end of the temperature curve in the diagram of FIG. 2. Due to the arrangement of the temperature sensor 12 in the vicinity of the upper water level in the siphon 9 an intimite heat contact results, on the one hand, and, on the other hand, visible installations for triggering the flushing event are avoided. By employing a change of the temperature gradient above a preset minimal value, slow changes of the temperature detected by the temperature sensor 12 within the siphon 9 based on changes of the ambient temperature do not result in triggering the flushing events. However, temperature jumps caused by introduction of urine or waste water are immediately detected and result in a preferably delayed triggering of the flushing event.

Figure 3:
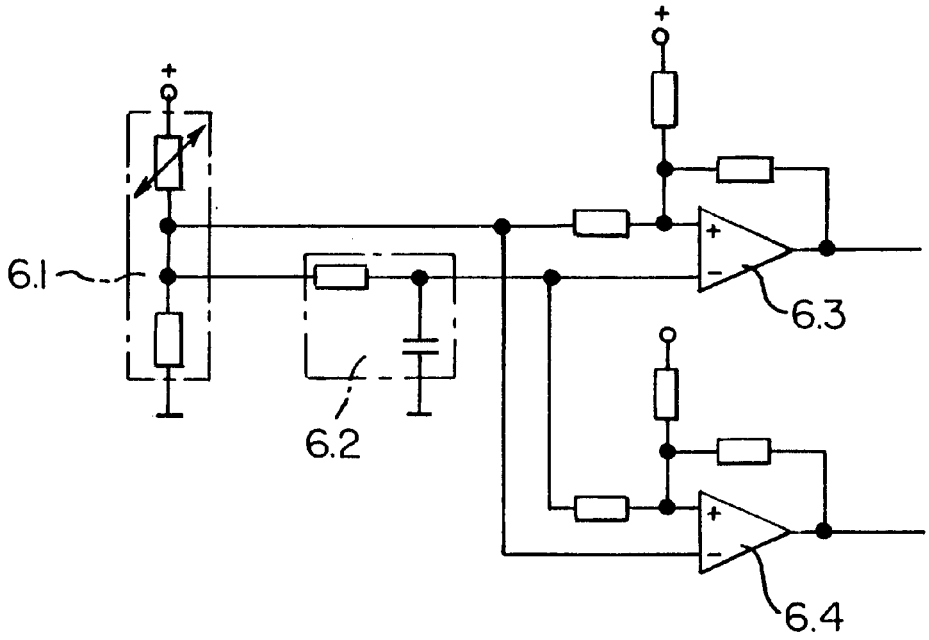
FIG. 3 an embodiment of an electronic circuit for generating a switching signal for triggering the flushing event.

With the circuit 6.1 represented in FIG. 3 a temperature-proportional signal is generated that is integrated within RC member 6.2. By further sending the resulting signal to comparators 6.3 and 6.4, a switching signal is produced when the present sensor signal surpasses the switching threshold that results from the integrated signal and electrical coupling with the comparators. The required averaging, comparing, and other operations for triggering the flushing event are performed with the aid of a microprocessor by using suitable computing programs. On the one hand, the rule applies that a flushing event is triggered when the actual temperature T is greater by a slight amount than the average temperature value of the past minutes. When, on the other hand, the temperature drops within a certain period of time by a certain amount, a flushing event is also triggered.

The present invention is, of course, in no way restricted to the specific disclosure of the specification and drawings, but also encompasses any modifications within the scope of the appended claims.

What is claimed is:

1. A method for automatically triggering flushing of a urinal with water, said method comprising the steps of:

arranging an electrically actuatable shut-off valve in the water inlet line for shutting off water flow;

positioning a temperature sensor at a siphon of the urinal;

sending signals generated by the temperature sensor to an electronic control and computing device;

determining with the electronic control and computing device a temperature gradient based on the signals generated by the temperature sensor; and opening the shut-off valve for flushing the urinal when the temperature gradient exceeds a preset limit.

2. A method according to claim 1, further comprising the step of delaying the step of opening the shut-off valve.

* * * * *

UNITED STATES PATENT AND TRADEMARK OFFICE

CERTIFICATE OF CORRECTION

PATENT NO : 6,061,843

DATED : May 16, 2000

INVENTOR(S): Hans Rump, Norbert Pieper, Jörg Hiller, and Jan Schwarze

It is certified that error appears in the above-identified patent and that said Letters Patent are hereby corrected as shown below:

On the title page, insert [30]:

[30] Foreign Application Priority Data

Mar. 30, 1994 [DE] Germany.....44 10 993.8

Signed and Sealed this

Third Day of April, 2001

*Attest:*

Nicholas P. Godici

NICHOLAS P. GODICI

*Attesting Officer*

*Acting Director of the United States Patent and Trademark Office*